US009174468B2

(12) United States Patent
Tomomatsu et al.

(10) Patent No.: US 9,174,468 B2
(45) Date of Patent: Nov. 3, 2015

(54) RECORDING APPARATUS

(71) Applicant: Brother Kogyo Kabushiki Kaisha, Nagoya-shi, Aichi-ken (JP)

(72) Inventors: Yoshitsugu Tomomatsu, Nagoya (JP); Junya Kawai, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/600,062

(22) Filed: Jan. 20, 2015

(65) Prior Publication Data

US 2015/0202901 A1 Jul. 23, 2015

(30) Foreign Application Priority Data

Jan. 20, 2014 (JP) ..... 2014-007926

(51) Int. Cl.
*B41J 11/00* (2006.01)
*B41J 13/00* (2006.01)

(52) U.S. Cl.
CPC ..... *B41J 13/0009* (2013.01)

(58) Field of Classification Search
USPC ..... 347/171, 215, 217–219, 220, 222; 400/223, 225, 611
See application file for complete search history.

(56) References Cited

U.S. PATENT DOCUMENTS

| | | | | |
|---|---|---|---|---|
| 5,502,477 | A * | 3/1996 | Osada et al. | 347/218 |
| 7,791,627 | B2 * | 9/2010 | Sakurai et al. | 347/219 |
| 2006/0001729 | A1 * | 1/2006 | Inana | 347/218 |

FOREIGN PATENT DOCUMENTS

| | | | |
|---|---|---|---|
| JP | H08-166861 | A | 6/1996 |
| JP | 3093958 | U | 5/2003 |
| JP | 2006-256097 | A | 9/2006 |

* cited by examiner

*Primary Examiner* — Kristal Feggins
(74) *Attorney, Agent, or Firm* — Banner & Witcoff, Ltd.

(57) ABSTRACT

The disclosure discloses a recording apparatus comprising a take-up body, a recording speed determining portion, a total length acquiring portion, and a take-up time determining portion. The take-up body sequentially takes up a recorded medium around a predetermined axis and produces a roll-shaped recorded matter. The recording speed determining portion determines a recording speed by a recording head based on a medium information acquired by a medium information acquiring portion. The total length acquiring portion acquires a total recording length by the recording head. The take-up time determining portion predicts and determines a take-up time by the take-up body before the take-up body starts take-up of the recorded medium, based on the total recording length acquired by the total length determining portion and the recording speed determined by the recording speed determining portion.

14 Claims, 17 Drawing Sheets

FIG. 12

| MEDIUM | PRINT MODE | |
|---|---|---|
| | STANDARD | FINE |
| PAPER TAPE | 225 [mm/s] | 150 [mm/s] |
| PET TAPE | 150 [mm/s] | 75 [mm/s] |
| CLOTH TAPE | 150 [mm/s] | 75 [mm/s] |
| CRAFT TAPE | 225 [mm/s] | 150 [mm/s] |

RECORDING APPARATUS

CROSS-REFERENCE TO RELATED APPLICATION

The present application claims priority from Japanese Patent Application No. 2014-007926, which was filed on Jan. 20, 2014, the disclosure of which is incorporated herein by reference in its entirety.

BACKGROUND

1. Field

The present disclosure relates to a recording apparatus that produces recorded matter.

2. Description of the Related Art

There are known recording apparatuses that form desired print while feeding adhesive tape with paste applied to its back surface. According to the prior art, an adhesive tape with print on which print has been formed is sequentially taken up around a core material, thereby producing a roll-shaped printed matter.

In a case where the roll-shaped printed matter is produced by take-up of the adhesive tape with print as described above, the time required from the start of printed matter production to completion may be relatively long, depending on the length of the adhesive tape with print taken up (in other words, the total printing length when printing is performed). When the time required until production completion is not known at the start of production, the user must aimlessly wait until production completion of the printed matter, resulting in inconvenience. In the prior art described above, such a point was not taken into particular consideration.

SUMMARY

It is therefore an object of the present disclosure to provide a recording apparatus that allows the user to find out the time required until completion of printed matter production, and is capable of improving convenience.

In order to achieve the above-described object, according to the aspect of the present application, there is provided a recording apparatus comprising a feeding roller configured to feed a long medium to be recorded, a medium information acquiring portion configured to acquire medium information related to the medium to be recorded, a data acquiring portion configured to acquire record data for recording on the medium to be recorded, a recording head configured to perform recording in accordance with the record data acquired by the data acquiring portion on the medium to be recorded fed by the feeding roller, and form a recorded medium, a take-up body configured to sequentially take up the recorded medium around a predetermined axis and produce a roll-shaped recorded matter, a recording speed determining portion configured to determine a recording speed by the recording head based on the medium information acquired by the medium information acquiring portion, a total length acquiring portion configured to acquire a total recording length by the recording head, and a take-up time determining portion configured to predict and determine a take-up time by the take-up body before the take-up body starts take-up of the recorded medium, based on the total recording length acquired by the total length determining portion and the recording speed determined by the recording speed determining portion.

In the recording apparatus of the present disclosure, when the medium to be recorded is fed by the feeding roller, recording based on record data is executed on the fed medium to be recorded by a recording head. The recorded medium after recording has been performed is sequentially taken up around a predetermined axis by a take-up body, thereby producing a roll-shaped recorded matter.

Then, according to the present disclosure, before the start of recorded matter production, the aforementioned required time is estimated and displayed. That is, recording speed determining portion determines the recording speed by the recording head based on medium information of the medium to be recorded acquired by medium information acquisition portion. Based on this determined recording speed and the total recording length acquired by total length acquisition portion, take-up time determining portion predicts and determines the take-up time by the take-up body. Then, a first display signal for displaying the determined take-up time is output from the first display signal output portion.

With this arrangement, it is possible to display the take-up time of the take-up body to be executed in the production by suitable display device. As a result, before the start of recorded matter production, the user can find out the time required until completion of recorded matter production. Accordingly, it is possible to improve convenience for the user.

BRIEF DESCRIPTION OF THE DRAWINGS

FIG. 12 is a printing speed table used for determining the printing speed.

DETAILED DESCRIPTION OF THE PREFERRED EMBODIMENTS

Figure 1:
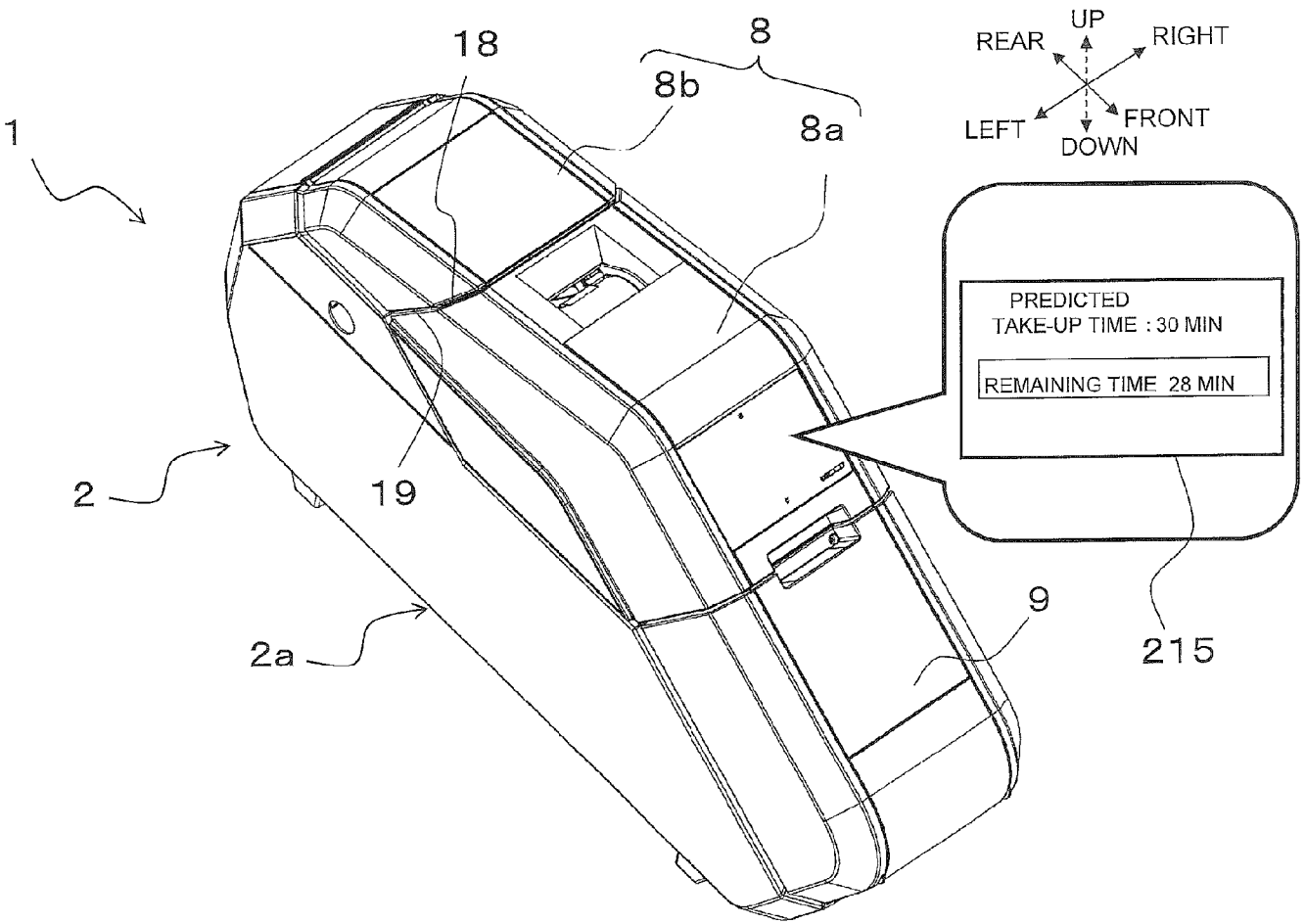
FIG. 1 is a perspective view showing the outer appearance of the tape printer related to an embodiment of the present disclosure.

The following describes an embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 comprises a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes the area above the frontward side of the first storage part 3.

Figure 2:
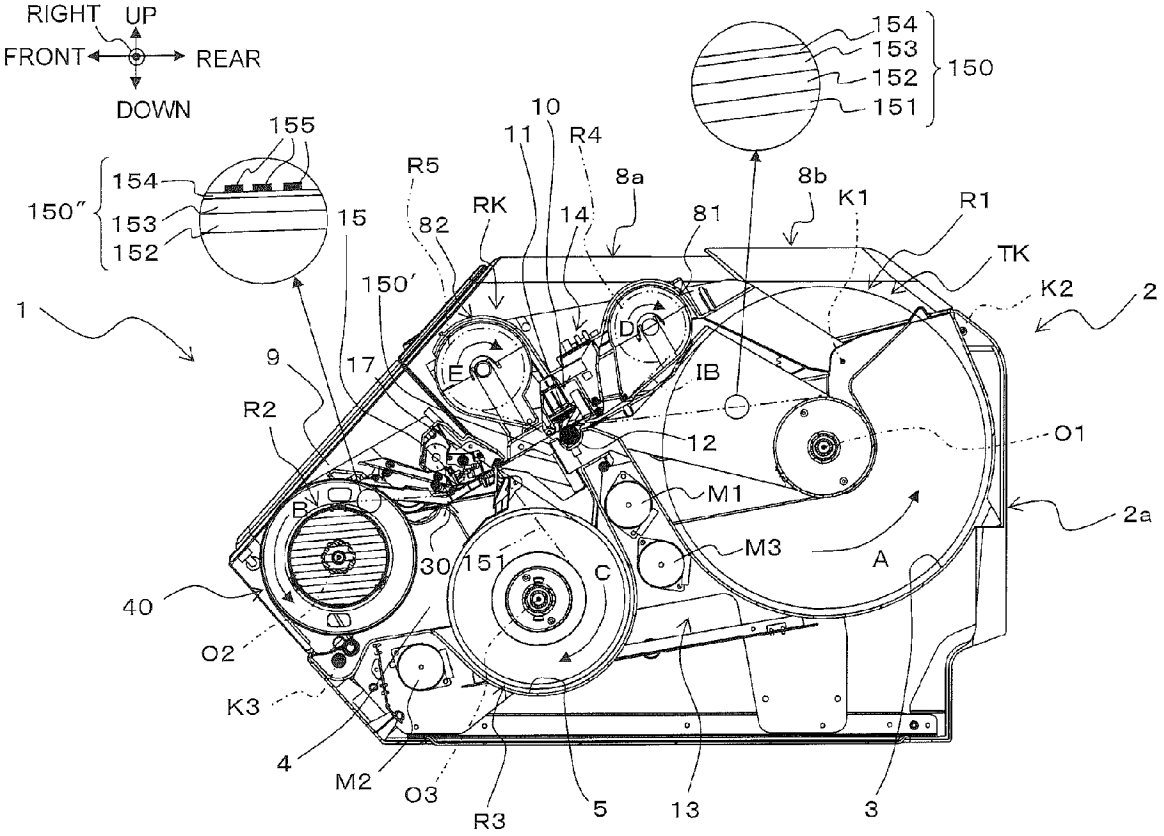
FIG. 2 is a side cross-sectional view showing the internal structure of the tape printer.
Figure 3:
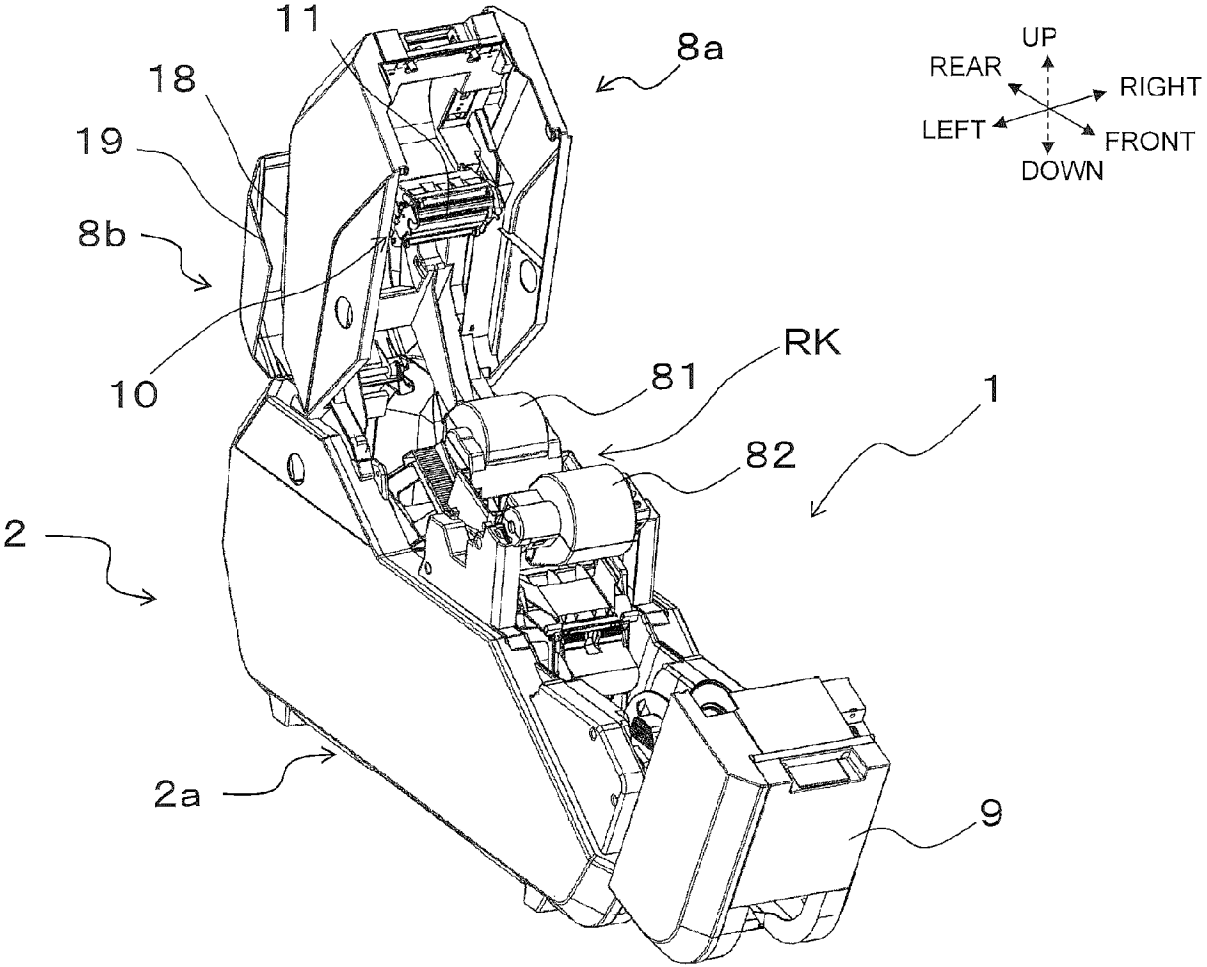
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a print head 11 included in the head holding body 10 relatively closer to or farther away from a feeding roller 12 disposed in the housing main body 2*a*. That is, the print head 11 moves close to the feeding roller 12 in the above described closed position (the states in FIGS. 1 and 2) of the first opening/closing cover 8*a*, and moves away from the feeding roller 12 in the above described open position (the states in FIGS. 3 and 4) of the first opening/closing cover 8*a*.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes the area above the rearward side of the first storage part 3.

Then, the first opening/closing cover 8*a* and the second opening/closing cover 8*b* are configured so that, when each is closed, an outer circumference part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes the area above the third storage part 4.

Print-Receiving Tape Roll and Surrounding Area Thereof

Figure 4:
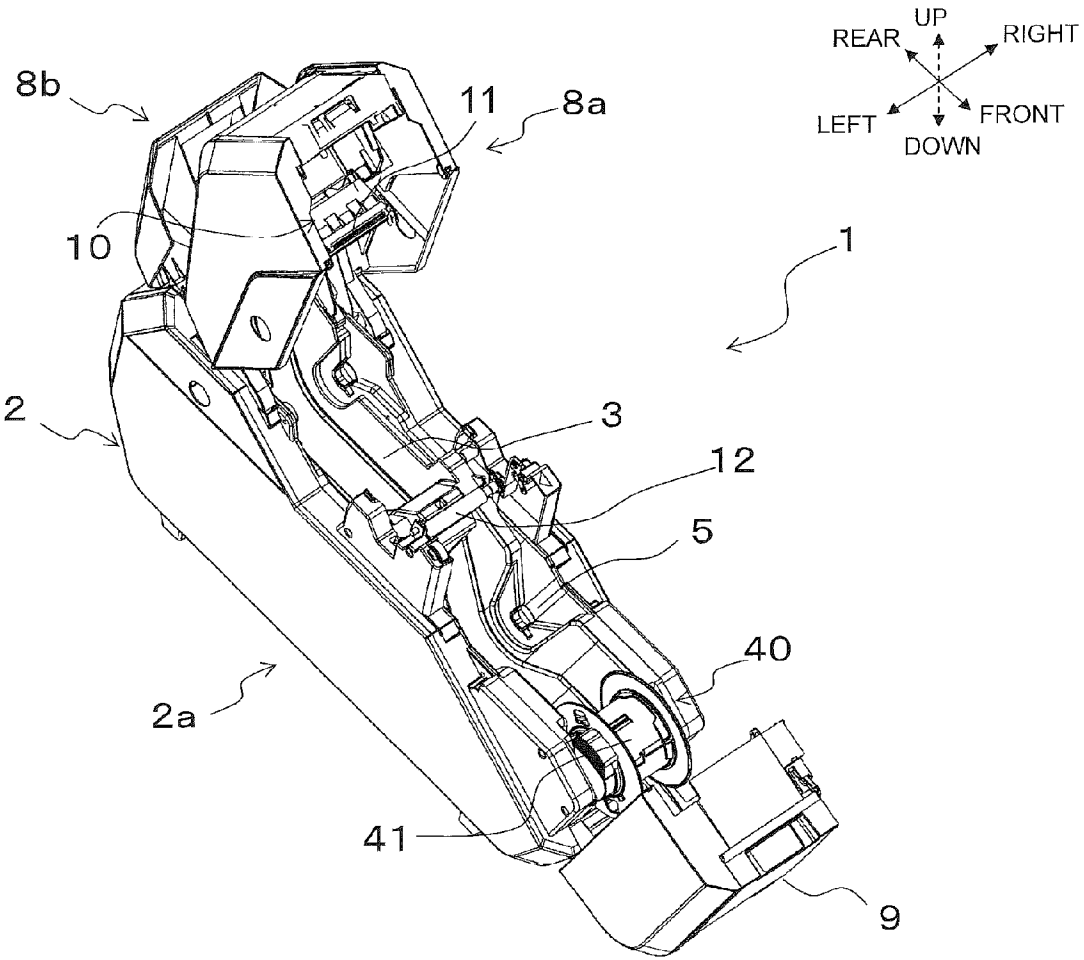
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) in the housing main body 2*a*. This tape cartridge TK comprises a first roll R1 wound around and formed on an axis O1.

Figure 5:
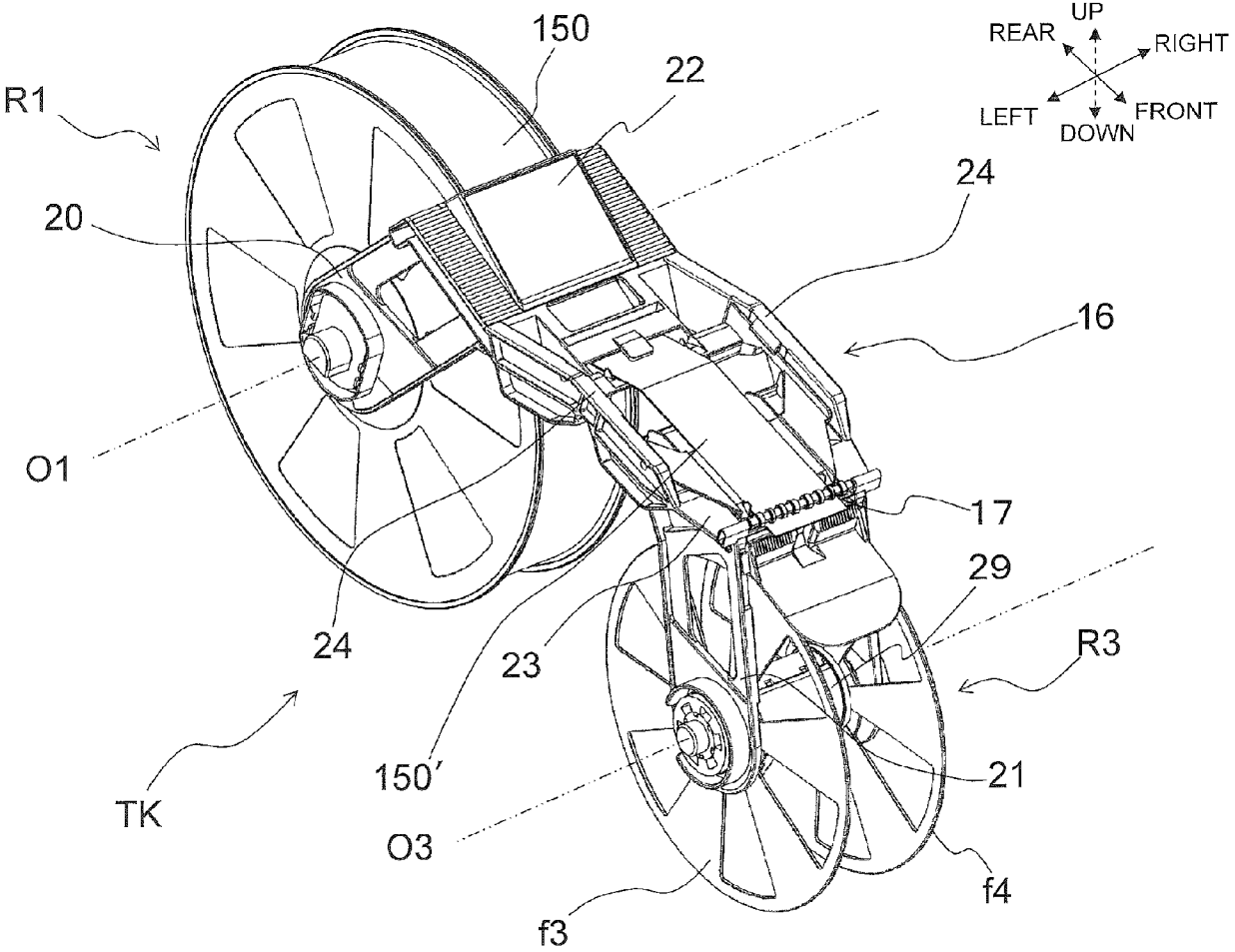
FIG. 5 is a perspective view showing the overall configuration of the tape cartridge.

That is, the tape cartridge TK comprises the first roll R1 and a connecting arm 16, as shown in FIG. 5. The connecting arm 16 comprises a left and right pair of first bracket parts 20, 20 disposed on the rearward side, and a left and right pair of second bracket parts 21, 21 disposed on the frontward side.

The first bracket parts 20, 20 are set so that the above described first roll R1 is sandwiched from both the left and right sides along the axis O1, holding the first roll R1 rotatably around the axis O1 with the tape cartridge TK mounted to the housing main body 2*a*. These first bracket parts 20, 20 are connected by a first connecting part 22 that is extended substantially along the left-right direction on the upper end, avoiding interference with the outer diameter of the first roll R1.

The first roll R1 is rotatable when the tape cartridge TK is mounted in the interior of the housing main body 2*a*. The first roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The first roll R1 is received in the first storage part 3 from above by the mounting of the above described tape cartridge TK and stored with the axis O1 of the winding of the print-receiving tape 150 in the left-right direction. Then, the first roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer of ink from the above described print head 11. The adhesive layer 152 is a layer for affixing the base layer 153 to a suitable adherent (not shown). The separation material layer 151 is a layer that covers the adhesive layer 152.

Feeding Roller and Print Head

Returning to FIGS. 2-4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the first roll R1 stored in the first storage part 3 in a tape posture in which the tape-width direction is in the left-right direction.

Further, the above described head holding part 10 disposed on the first opening/closing cover 8*a* comprises the above described print head 11. The print head 11, as described above, is capable of moving relatively closer to or farther away from the feeding roller 12 by the pivoting of the first opening/closing cover 8*a* around the pivot axis K1. This print head 11 is disposed in a position that faces the area above the feeding roller 12 of the head holding part 10, with the first opening/closing cover 8*a* closed, sandwiching the print-receiving tape 150 fed by the feeding roller 12 in coordination with the feeding roller 12. Accordingly, when the first opening/closing cover 8*a* is closed, the print head 11 and the feeding roller 12 are disposed facing each other in the up-down direction. Then, the print head 11 forms desired print on the print-receiving layer 154 of the print-receiving tape 150 sandwiched between the print head 11 and the feeding roller 12 using an ink ribbon IB of an ink ribbon cartridge RK described later, thereby forming a tape 150' with print.

Ink Ribbon Cartridge

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. This ink ribbon cartridge RK comprises a ribbon feed-out roll R4 around which is wound the unused ink ribbon IB in manner that enables feed-out, and a ribbon take-up roll R5. A rearward-side feed-out roll storage part 81 and a frontward-side take-up roll storage part 82 is connected by a center connecting part (not shown) of the ink ribbon cartridge RK. The connecting part connects the above described take-up roll storage part 82 and the above described feed-out roll storage part 81 while exposing the above described ink ribbon IB fed out from the ribbon feed-out roll R4 to the outside of the ink ribbon cartridge RK.

The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the print head 11.

The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the print head 11 side of the print-receiving tape 150 sandwiched between the print head 11 and the feeding roller 12, contacting the area below the print head 11. Then, after the ink of the ink ribbon IB is transferred to the print-receiving layer 154 of the print-receiving tape 150 by the heat from the print head 11 to execute print formation, the used ink ribbon IB is taken up on the ribbon take-up roll R5.

Separation Material Roll and Surrounding Area Thereof

As shown in FIG. 5, the connecting arm 16 of the tape cartridge TK comprises a peeling part 17 that includes a substantially horizontal slit shape, for example. This peeling part 17 is an area that peels the separation material layer 151 from the tape 150' with print fed out from the first roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152.

The tape cartridge TK, as shown in FIG. 2 and FIG. 5, comprises a third roll R3 formed by winding the above described peeled separation material layer 151 around an axis O3. That is, the third roll R3 is received in the above described second storage part 5 from above by the mounting of the aforementioned tape cartridge TK and stored with the axis O3 for winding the separation material layer in the left-right direction. Then, the third roll R3, stored in the second storage part 5 (with the tape cartridge TK mounted), is driven by a separation sheet take-up motor M3 that is disposed inside the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so that the above described third roll R3 is sandwiched from both the left and right sides along the axis O3, holding the third roll R3 rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are connected by a left and right pair of roll connecting beam parts 24, 24.

Further, FIG. 5 shows the state before the separation material layer 151 is wound around the axis O3 and the third roll R3 is formed (in the case of the unused tape cartridge TK). That is, FIG. 5 shows substantially circular roll flange parts f3, f4 disposed so as to sandwich both width-direction sides of the separation material layer 151, and conveniently denotes the location where the third roll R3 is formed using the reference number "R3."

Tape Roll with Print and Surrounding Area Thereof

On the other hand, as shown in FIG. 2 and FIG. 4, a take-up mechanism 40 for sequentially winding the above described tape 150" with print is received in the above described third storage part 4 from above. The take-up mechanism 40 is stored so that it is supported rotatably around an axis O2 with the axis O2 of the winding of the tape 150" with print in the left-right direction. Then, the take-up mechanism 40, stored in the third storage part 4, is driven by an adhesive take-up motor M2 that is disposed in the interior of the housing main body 2*a* via a gear mechanism (not shown) and rotates in a predetermined rotating direction (a direction B in FIG. 2) inside the third storage part 4, taking up and layering the tape 150" with print. With this arrangement, the tape 150" with print is sequentially wound around the outer circumference side of the take-up mechanism 40, forming a second roll R2.

Cutter

Further, as shown in FIG. 2, a cutter 30 is disposed on the downstream side of the print head 11 and the upstream side of the second roll R2, along the tape transport direction.

The cutter 30, while not shown in detail, comprises a movable blade and a carriage that supports the movable blade and is capable of travelling in the tape-width direction (in other words, the left-right direction). Then, the carriage travels by the driving of a cutter motor MC (refer to FIG. 6 described later) and the movable blade moves in the tape-width direction, cutting the above described tape 150" with print in the width direction.

Overview of Operation of Tape Printer

Next, an overview of the operation of the tape printer 1 with the above described configuration will be described.

That is, when the tape cartridge TK is mounted in the above described first predetermined position 13, the first roll R1 is stored in the first storage part 3 positioned on the rearward side of the housing main body 2*a*, and the axis O3 side that forms the third roll R3 is stored in the second storage part 5 positioned on the frontward side of the housing main body 2*a*. Further, the take-up mechanism 40 for forming the second roll R2 is stored in the third storage part 4 positioned on the frontward side of the housing main body 2*a*.

At this time, when the feeding roller 12 is driven, the print-receiving tape 150 fed out by the rotation of the first roll R1 stored in the first storage part 3 is fed to the frontward side. Then, desired print is formed by the print head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming the tape 150" with print. The peeled separation material layer 151 is fed to the downward side, introduced to and wound inside the second storage part 5, forming the third roll R3.

On the other hand, the tape 150" with print from which the separation material layer 151 was peeled is further fed to the frontward side, introduced to the third storage part 4, and wound on the outer circumference side of the take-up mechanism 40 inside the third storage part 4, thereby forming the second roll R2. At this time, the cutter 30 disposed on the transport direction downstream side (that is, the frontward side) cuts the tape 150" with print. With this arrangement, the tape 150" with print wound around the second roll R2 can be cut based on a timing preferred by the user and the second roll R2 can be removed from the third storage part 4 after cutting.

Note that, at this time, although not explained by illustration, a non-adhesive tape (one without the above described adhesive layer 152 and separation material layer 151) may be wound around the first roll R1. In this case as well, the first roll R1 which winds the non-adhesive tape is received in the first storage part 3 from above by the mounting of the tape cartridge TK and stored with the axis O1 of the winding of the non-adhesive tape in the left-right direction. Then, the first roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the second roll R2 and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described above by switching the tape path by a switch operation of the shoot 15 using a switch lever (not shown).

Control System

Figure 6:
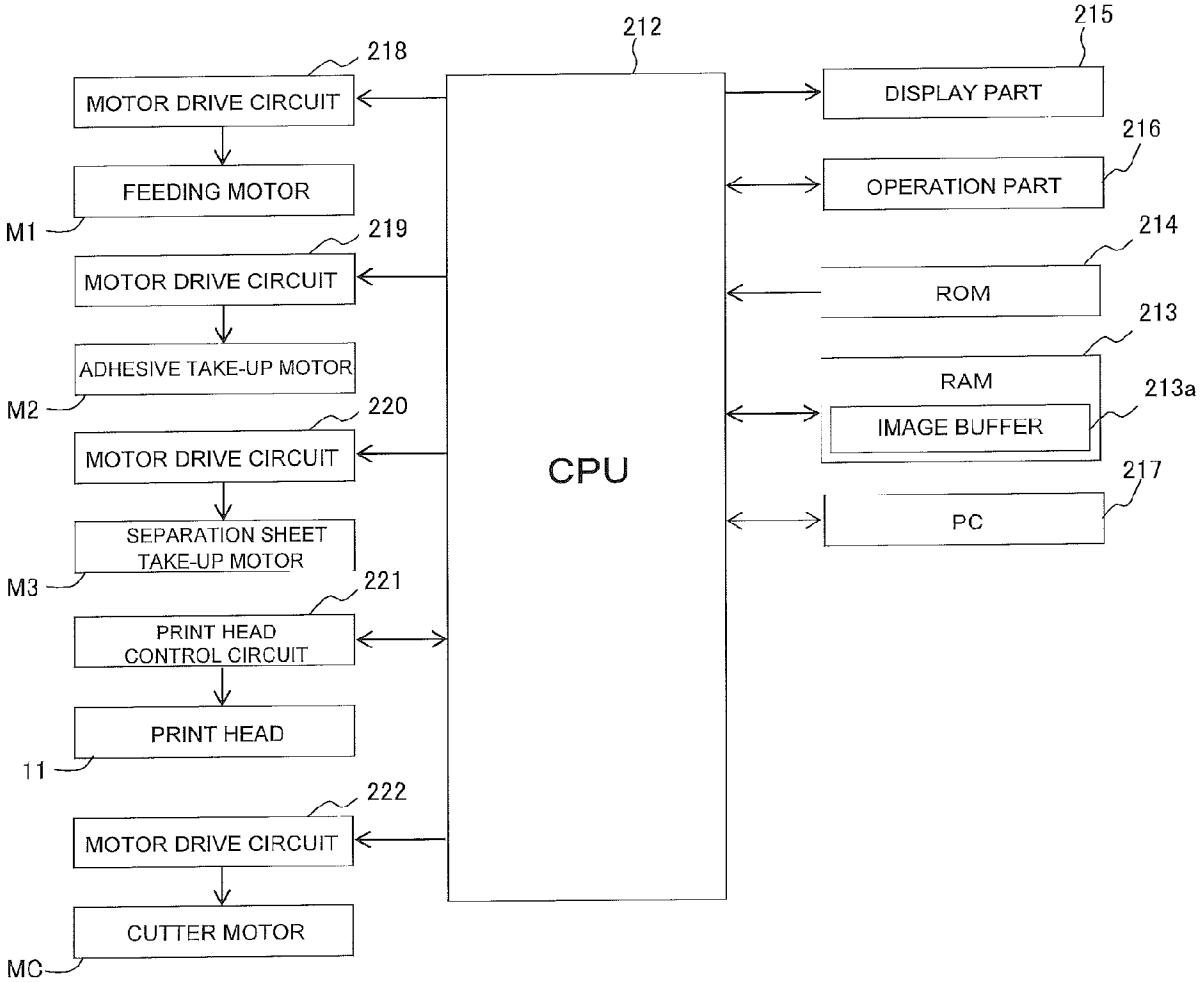
FIG. 6 is a function block diagram showing the configuration of the control system of the tape printer.

Next, the control system of the tape printer 1 will be described using FIG. 6. In FIG. 6, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the above described second roll R2, a motor driving circuit 220 that controls the driving of the above described separation sheet take-up motor M3 that drives the above described third roll R3, a print head control circuit 221 that controls the conduction of the heating elements of the above described print head 11, a motor driving circuit 222 that controls the driving of the cutter motor MC that causes the carriage comprising the above described movable blade to travel, a display part 215 that performs suitable displays, and an operation part 216 that permits suitable operation input by the user. Further, while the CPU 212 is connected to a PC 217 serving as an external terminal in this example, the CPU 212 does not need to be connected in a case where the tape printer 1 operates alone (a so-called all-in-one type).

The ROM 214 stores control programs for executing predetermined control processing (including programs that execute the flow processing in FIG. 10, FIG. 11, FIG. 13, FIG. 15, FIG. 16, and FIG. 17 described later). The RAM 213 comprises an image buffer 213*a* that expands print data (refer to step S203 described later) generated in correspondence with an operation by an operator using the above described operation part 216 (or the above described PC 217) into dot pattern data for printing in a predetermined print area of the above described print-receiving layer 154, and stores the data, for example. The CPU 212 prints one image (unit print image data) corresponding to the above described dot pattern data stored in the image buffer 213*a* while feeding out the print-receiving tape 150 by the feeding roller 12 on the print-receiving tape 150 by the print head 11 (repeatedly along the tape longitudinal direction), based on the above described control programs.

Behavior from Start of Take-Up to Completion

In the above, the essential point in this embodiment is the prediction of the time required for take-up (before take-up completion) when the tape 150" with print is wound by the take-up mechanism 40 as described above, forming the second roll R2. First, the specific behavior from the start of the above described take-up to completion will be described based on FIGS. 7A-7C, FIGS. 8A-8C, and FIGS. 9A-9C.

Preparation Processing

Figure 7A:
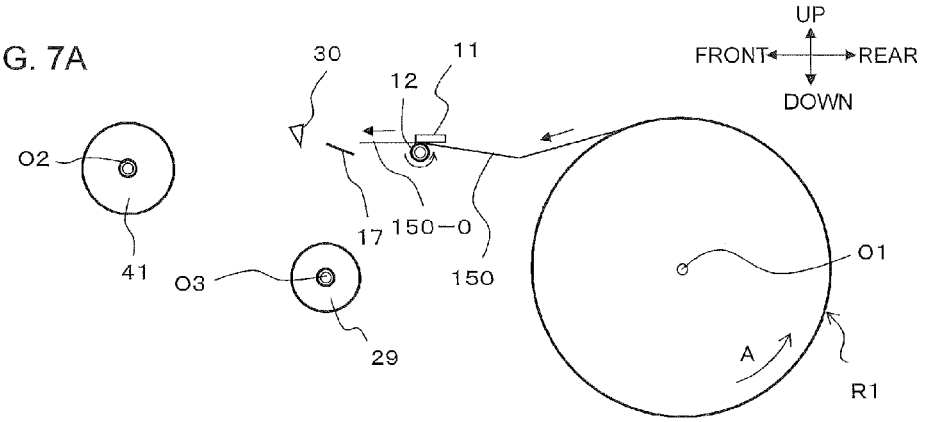
FIGS. 7A-7C is an explanatory view showing the tape feeding, take-up behavior, and the like in preparation processing.
Figure 7B:
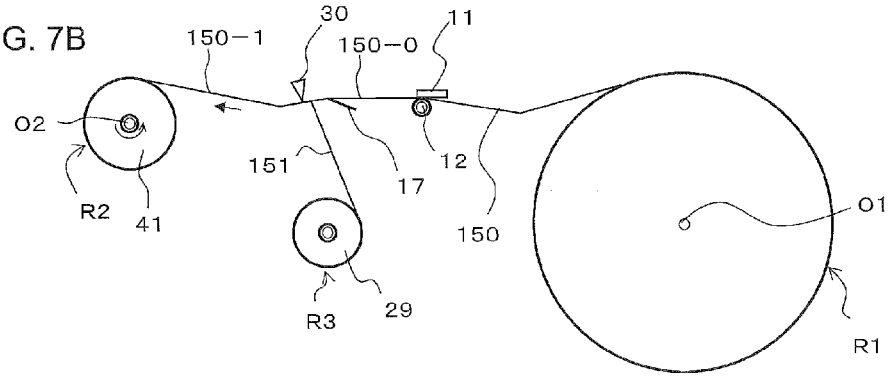
Figure 7C:
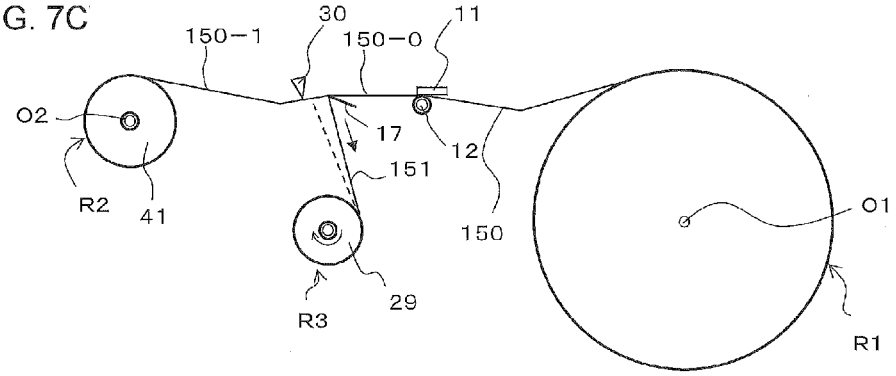

According to this embodiment, before the aforementioned feeding, print formation, and the like, first, predetermined preparation processing is performed. FIGS. 7A-7C schematically show this preparation processing step. First, the user manually feeds out the print-receiving tape 150 from the first roll R1 of the tape cartridge TK, and passes the fed out print-receiving tape 150 between the feeding roller 12 and the print head 11 (refer to FIG. 7A). At this time, the CPU 212 controls the feeding motor M1 for a predetermined period of time so that the feeding roller 12 is rotated in the transport direction. Note that the print-receiving tape 150 passed between the feeding roller 12 and the print head 11 and advanced to the downstream side thereof in this manner is referred to as a tape 150-0 for convenience of explanation. This tape 150-0 is an area corresponding to the tape 150' with print after the start of print formation by the print head 11 described later.

Subsequently, the user manually peels the separation material layer 151 from the above described tape 150-0, and secures the tip end of a tape 150-1 (an area corresponding to the tape 150" with print after the start of print formation by the print head 11 described later) made of the base layer 153 and the adhesive layer 152 to a winding core 41 (refer to FIG. 4) of the take-up mechanism 40 for forming the second roll R2. With this arrangement, the above described second roll R2 is formed by the winding of the tape 150-1 and the above described tape 150" with print with the rotation of the winding core 41 thereafter. On the other hand, the user secures the tip end of the separation material layer 151 peeled from the tape 150-0 to a winding core 29 (refer to FIG. 5) for forming the third roll R3 (refer to FIG. 7B). With this arrangement, the above described third roll R3 is formed by the winding of the separation material layer 151 with the rotation of the winding core 29 thereafter.

In this state, the CPU 212 stops the feeding roller 12 for a predetermined period of time and controls the feeding motor M1 and the adhesive take-up motor M2 so that only the above described winding core 41 is rotated in the take-up direction (refer to FIG. 7B). With this arrangement, the above described tape 150-1 from which the separation material layer 151 was peeled is pulled by the stopped feeding roller 12 and the winding core 41 that rotates in the take-up direction and, at the moment that the slack is removed, the rotation of the winding core 41 stops, causing tension to be applied to the tape 150-1. Note that, if rotation of the winding core 41 is detected at the moment that tension is to be applied to the tape 150-1 in this manner, the winding core 41 (in other words, the second roll R2) is regarded as rotating idly since the tip end of the tape 150-1 is not well secured to the winding core 41, and a defect is reported (refer to step S135 and step S190 described later).

Next, the CPU 212 stops the feeding roller 12 for a predetermined period of time and controls the feeding motor M1 and the separation sheet take-up motor M3 so that only the above described winding core 29 is rotated in the take-up direction (refer to FIG. 7C). With this arrangement, the separation material layer 151 peeled from the tape 150-0 is pulled by the stopped feeding roller 12 and the winding core 29 (in other words, the third roll R3) that rotates in the take-up direction and, at the moment that the slack is removed, the rotation of the winding core 29 stops, causing tension to be applied to the tape 150-0. Further, at this time, even if the separation point between the tape 150-0 and the separation material layer 151 has moved by the retraction of the tape 150-0 due to the rotation of the above described second roll R2 only, the point can be returned to its original position (refer to the broken line in FIG. 7C). Note that, if rotation of the third roll R3 is detected at the moment that tension is to be applied to the separation material layer 151 in this manner, the third roll R3 is regarded as rotating idly since the tip end of the separation material layer 151 is not well secured to the above described winding core 29, and a defect is reported (refer to step S155 and step S198 described later).

Next, the CPU 212 controls the feeding motor M1, the adhesive take-up motor M2, and the separation sheet take-up motor M3 for a predetermined period of time so as to rotate the feeding roller 12, the second roll R2, and the third roll R3 (without performing a print operation; not particularly shown). With this final verification operation, it is possible to verify in advance whether or not the series of operations including the feed-out and feeding of the print-receiving tape 150, the feeding of the tape 150-0, the feeding and take-up of the tape 150-1, the peeling and take-up of the separation material layer 151, and the like are normally performed.

Print Formation

Figure 8A:
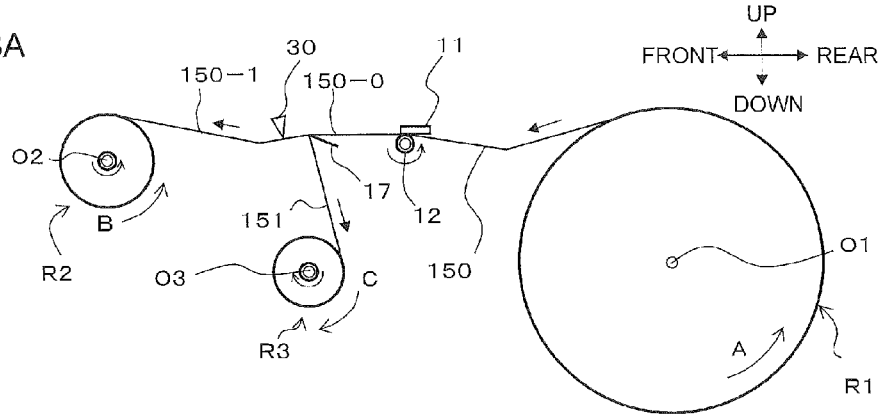
FIGS. 8A-8B is an explanatory view showing the tape feeding, print formation, tape take-up behavior, and the like during printed matter production.

After the above described preparation processing, the above described printed matter is produced by the aforementioned print formation. That is, as already described, the print-receiving tape 150 is fed by the feeding roller 12 from the state shown in FIG. 7C, as shown in FIG. 8A. Note that the feeding speed at this time is a fixed value individually determined in advance in accordance with selection results of a material and print mode (standard mode or fine mode) of the print-receiving tape 150 in this example (refer to FIG. 12 described later).

Figure 8B:
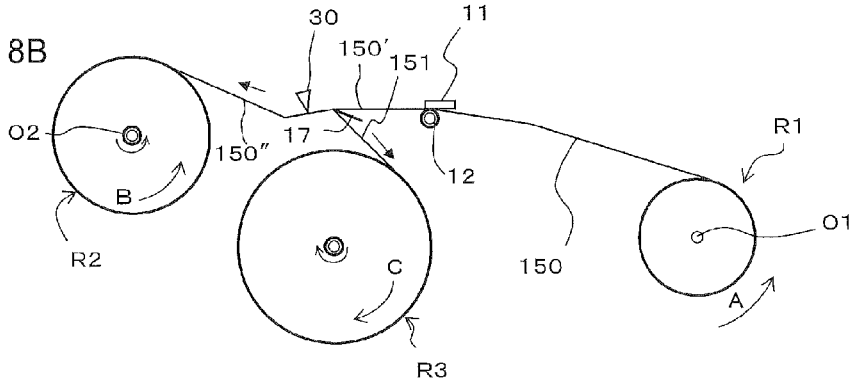

Subsequently, as already described, the feed-out and feeding of the print-receiving tape 150, the generation and feeding of the tape 150' with print resulting from print formation on the print-receiving tape 150, the generation of the tape 150" with print resulting from the peeling of the separation material layer 151 from the tape 150' with print and the take-up of the peeled separation material layer 151, and the feeding and take-up of the tape 150" with print (hereinafter suitably collectively referred to as the "printed matter formation operation") is started (refer to FIG. 8B). The tape 150" with print resulting from the peeling of the separation material layer 151 from the tape 150' with print is sequentially taken up around the axis O2 by the take-up mechanism 40.

Figure 9A:
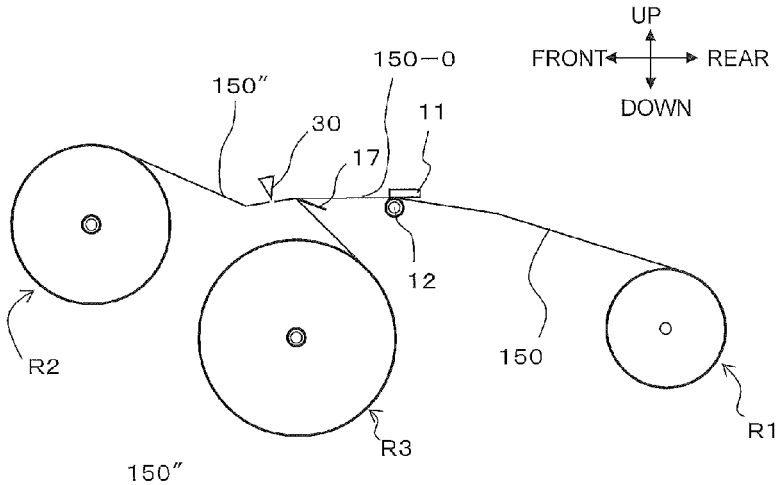
FIGS. 9A-9B is an explanatory view showing the tape feeding, cutting, take-up behavior, and the like during printed matter production.

Subsequently, the printed matter formation operation advances further from the state shown in FIG. 8B and, once the print-receiving tape 150, the tape 150' with print, and the tape 150" with print are in a specific transport direction position determined in advance before the start of the printed matter production operation, the rotation of the feeding roller 12, the second roll R2, and the third roll R3 is stopped as shown in FIG. 9A. As a result, the feed-out and feeding of the above described print-receiving tape 150, the feeding of the tape 150' with print, and the feeding and take-up of the tape 150" with print stop (note that print formation is stopped in advance of the above described stop so that the area between the cutter 30 and the print head 11 becomes an area of the above described tape 150-0, where printing is not formed, in this stopped state). In this state, the cutter 30 cuts the tape 150" with print between the feeding roller 12 and the second roll R2 (refer to FIG. 9A).

Finishing Processing

After the above described cutting, finishing processing is performed. That is, the adhesive take-up motor M2 is controlled so that the second roll R2 stops after rotation for a predetermined amount of time in the take-up direction (with the feeding roller 12 stopped as is). That is, after completion of the cutting of the tape 150" with print by the cutter 30, the second roll R2 does not stop immediately, but rather after rotation for a predetermined amount of time. With this arrangement, the second roll R2 is rotated a predetermined amount after cutting completion, and the end edge of the tape 150" with print generated by cutting is reliably taken up on the second roll R2 (refer to FIG. 9B). With this arrangement, one second roll R2 around which the tape 150" with print is wound is generated.

Required Time for Take-Up

In a case where the roll-shaped printed matter is produced by take-up of the adhesive tape 150" with print in this manner, the time required from the start of production of the above described printed matter to completion may be relatively long, depending on the length of the tape 150" with print taken up (in other words, the total printing length when printing is performed by the print head 11). When the time required until production completion is not known at the start of production, the user must aimlessly wait until production completion of the printed matter, resulting in inconvenience.

Control Procedure

Hence, according to this embodiment, before the start of printed matter production, the printing speed by the print head 11 is determined based on medium information (described later) of the print-receiving tape 150, and the take-up time by the above described take-up mechanism 40 is predicted and determined based on the determined printing speed and the total printing length of the above described tape 150" with print. Then, the determined take-up time is displayed. The control procedure executed by the CPU 212 for this will now be described using the flow in FIG. 10. Note that, in FIG. 10, the name of each component is suitably abbreviated (the same for FIG. 11 and FIG. 13 described later as well).

Figure 10:
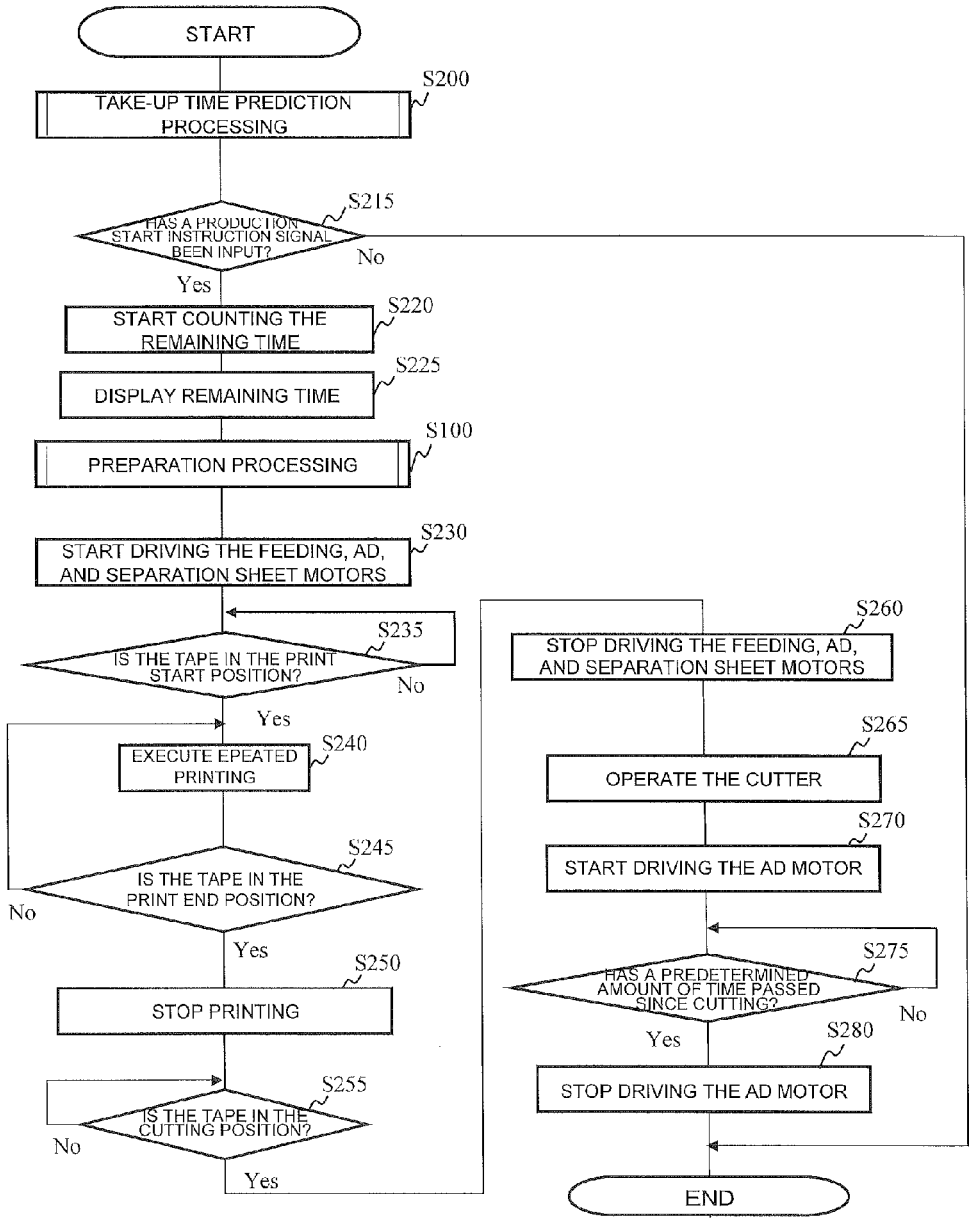
FIG. 10 is a flowchart showing the control procedure executed by the CPU during printed matter production.

FIG. 10 is a flowchart showing the control procedure executed by the CPU 212 during print formation. In FIG. 10, the flow is started by the user turning ON the power of the tape printer 1, for example ("START" position).

First, in step S200, the CPU 212 executes take-up time prediction processing.

Control of Take-Up Time Prediction Processing

Figure 11:
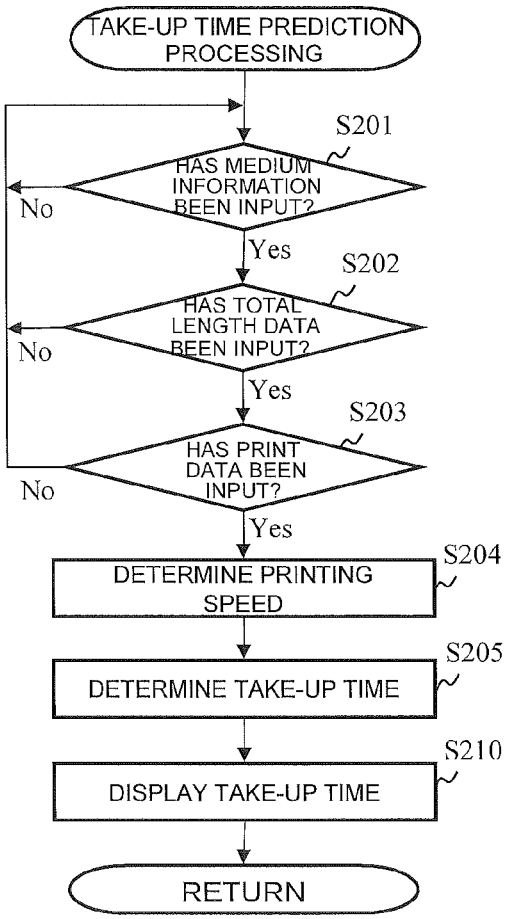
FIG. 11 is a flowchart showing the detailed procedure of step S200 in FIG. 10.
Figure 13:
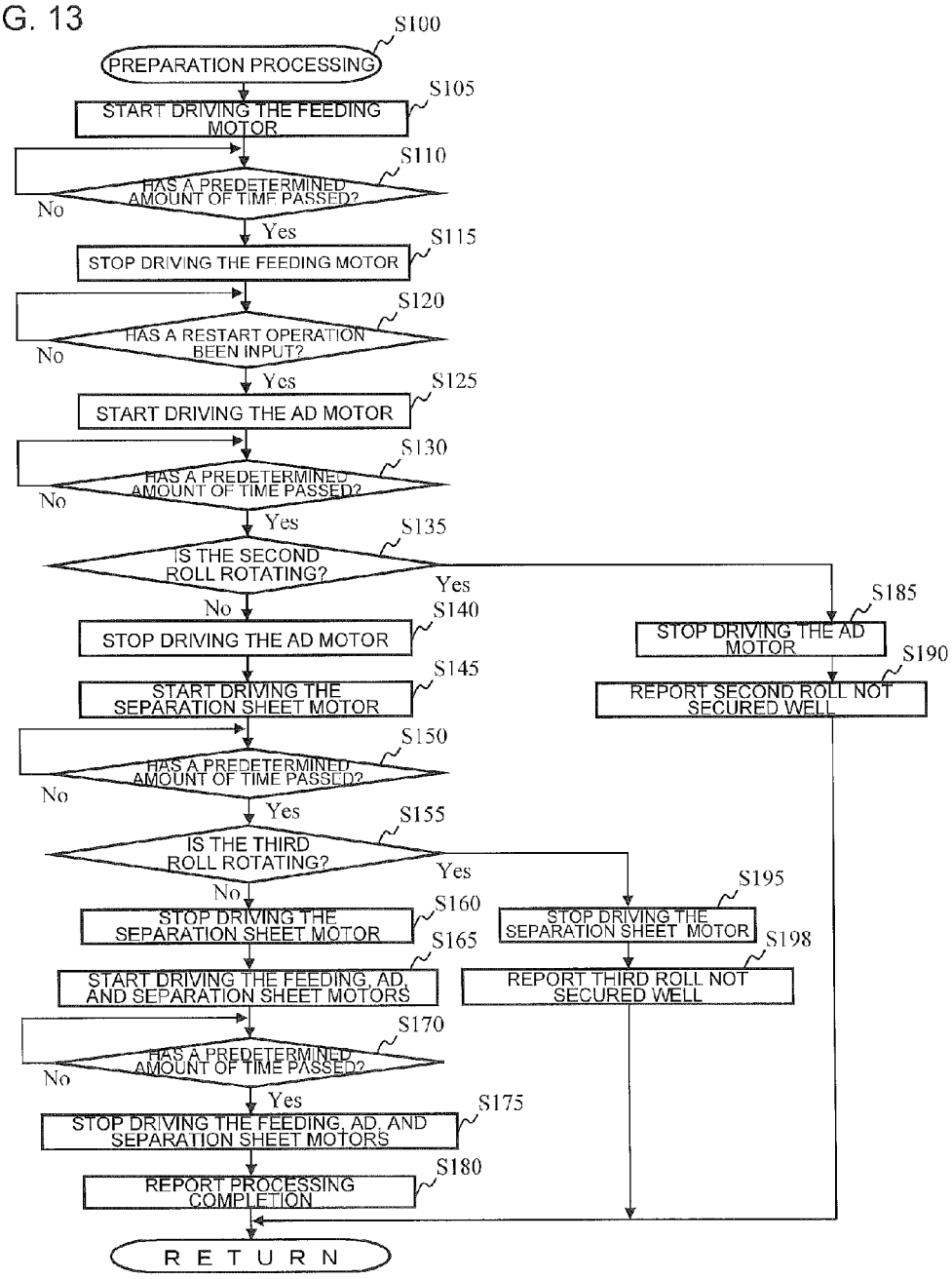
FIG. 13 is a flowchart showing the detailed procedure of step S100 in FIG. 10.

The following describes the control procedure of the take-up time prediction processing in the above described step S200, using FIG. 11.

First, in step S201, the CPU 212 determines whether or not the medium information, such as the material and type of the print-receiving tape 150, has been input based on a detection result of a suitable medium detection sensor (not shown) disposed inside the housing 2, for example (or input results from the operation part 216 or the above described PC 217 by the user). According to this embodiment, paper tape, PET tape, cloth tape, craft tape, or the like may be selectively used as the material (type) of the above described print-receiving tape 150, for example, and the applicable material (type) of these is input as the above described medium information. During the period in which the above described medium information is not input, the condition of step S201 is not satisfied (S201: NO), and the flow loops back and enters a standby state. Once the above described medium information is input, the condition of step S201 is satisfied (S201: YES), and the flow proceeds to step S202.

In step S202, the CPU 212 determines whether or not the total length data indicating the length of the printed matter to be produced (in other words, the total length which is the total printing length along the transport direction of the above described tape 150" with print to be generated) has been input in accordance with an operation by the user using the operation part 216 (or the above described PC 217). According to this embodiment, the operator can specify the length of the above described tape 150" with print to be generated in meters by an operation input, for example, and the value input by the operation is then input as the above described total length data. If the above described total length data has not been input, the condition of step S202 is not satisfied (S202: NO), the flow returns to the above described step S201, and the same procedure is repeated. Once the above described total length data is input, the condition of step S202 is satisfied (S202: YES), and the flow proceeds to step S203.

In step S203, the CPU 212 determines whether or not print data indicating one image to be formed by print (by repeated print in the tape longitudinal direction in this example) on the above described print-receiving tape 150 has been input in accordance with a user operation using the operation part 216 (or the above described PC 217). According to this example, the operator can suitably input (or select) the text print, image, and the like corresponding to the above described one image and, in this step S203, the above described one image corresponding to the operation input (or selection) is acquired. If the print data has not been input, the condition of step S203 is not satisfied (S203: NO), the flow returns to the above described step S201, and the same procedure is repeated. Once the above described print data is input, the condition of step S203 is satisfied (S203: YES), and the flow proceeds to step S204.

In step S204, the CPU 212 determines the printing speed by the print head 11 (in other words, the feeding speed by the feeding roller 12 performed in synchronization with the print formation operation) based on the above described medium information (material, type, and the like) acquired in the above described step S202. To make the determination at this time, the CPU 212 uses the printing speed table (shown in FIG. 12) that is prepared and stored in a suitable location in advance, for example. As shown in FIG. 12, in this example, the four types of the above described "paper tape," "PET tape," "cloth tape," and "craft tape" are presumed in advance as the materials (types) of the print-receiving tape 150. Further, "standard mode" and "fine mode" are prepared as the two print modes for each material, and either mode is selectable in accordance with a user operation using the operation part 216 (or the above described PC 217), for example. Then, the printing speed is uniquely set in accordance with the combination of each material and mode selection result.

In the example shown, if the print-receiving tape 150 is a paper tape, the printing speed is set to 225 [mm/s] in the above described standard mode, and to 150 [mm/s] in the above described fine mode. Similarly, if the print-receiving tape 150 is a PET tape, the printing speed is set to 150 [mm/s] in the above described standard mode, and to 75 [mm/s] in the above described fine mode. Further, if the print-receiving tape 150 is a cloth tape, the printing speed is set to 150 [mm/s] in the above described standard mode, and to 75 [mm/s] in the above described fine mode. If the print-receiving tape 150 is a craft tape, the printing speed is set to 225 [mm/s] in the above described standard mode, and to 150 [mm/s] in the above described fine mode. When step S204 ends, the flow proceeds to step S205.

In step S205, the CPU 212 predicts and determines the take-up time by the above described take-up mechanism 40, based on the above described total length data acquired in the above described step S202 and the above described printing speed determined in the above described step S204. Note that this take-up time generally includes the print formation time (FIG. 8A, FIG. 8B, and FIG. 9A) acquired by dividing the above described total length data by the above described printing speed, the take-up time (refer to FIGS. 7A-7C) to be executed during the above described preparation processing, set in a fixed manner, for example, and the tape take-up time (refer to FIG. 9B) during the above described finishing operation after the cutting of the tape 150" with print, set in a fixed manner, for example. When step S205 ends, the flow proceeds to step S210.

In step S210, the CPU 212 outputs a display signal that displays the take-up time determined in the above described step S205 on the display part 215 (or the PC 217), and displays the take-up time on the display part 215 (or the PC 217).

FIG. 1 shows an example in which "Predicted take-up time: 30 min." is displayed on the aforementioned display part 215. Once step S210 ends, the flow proceeds to step S215 in FIG. 10.

Returning to FIG. 10, in step S215, the CPU 212 determines whether or not a production start instruction signal corresponding to a production start operation for the above described printed matter performed by the user using the operation part 216 (or the above described PC 217) has been input. If the above described production start instruction signal has not been input, the condition of step S215 is not satisfied (S215: NO), and this flow is terminated. Once the above described production start instruction signal is input, the condition of step S215 is satisfied (S215: YES), and the flow proceeds to step S220.

In step S220, the CPU 212 starts counting the remaining time, which is acquired by subtracting the time that has passed since the production start instruction signal was input in the above described step S215 from the take-up time determined in the above described step S205, for example. When step S220 ends, the flow proceeds to step S225.

In step S225, the CPU 212 outputs a display signal that displays the remaining time for which counting was started in the above described step S215 on the display part 215 (or the PC 217), and displays the above described remaining time on the display part 215 (or the PC 217). The above described FIG. 1 shows an example in which "Remaining time: 28 min." is displayed on the aforementioned display part 215. When step S255 ends, the flow proceeds to step S100.

Control of Preparation Processing

In the above described step S100, the CPU 212 performs control for executing the above described preparation processing described using FIGS. 7A-7C. The details of the control procedure will now be described using FIG. 13.

First, in step S105, the CPU 212 outputs a control signal to the motor driving circuit 218, and starts driving the feeding motor M1 (refer to the aforementioned FIG. 7A). When step S105 ends, the flow proceeds to step S110.

In step S110, the CPU 212 determines whether or not a predetermined amount of time has passed since the driving of the feeding motor M1 was started in the above described step S105. If the predetermined amount of time has not passed, the condition of step S110 is not satisfied (step S110: NO), and the flow loops back and enters a standby state until the predetermined amount of time passes. In this case, the predetermined amount of time that the flow is in a standby state may be about the amount of time it takes for the above described tape 150-0 positioned on the tip end side of the print-receiving tape 150 fed out from the first roll R1 to be fed from the feeding roller 12 and arrive at the second roll R2 or the third roll R3. If the predetermined amount of time has passed, the condition of step S110 is satisfied (step S110: YES), and the flow proceeds to step S115.

In step S115, the CPU 212 outputs a control signal to the motor driving circuit 218 and stops the driving of the feeding motor M1. When step S115 ends, the flow proceeds to step S120.

In step S120, the CPU 212 determines whether or not an operation that instructs operation restart has been input by the user via the operation part 216 (or the above described PC 217). If the above described instruction operation has not been input, the condition of step S120 is not satisfied (step S120: NO), and the flow loops back and enters a standby state until the instruction operation is input. If the above described instruction operation has been input, the condition of step S120 is satisfied (step S120: YES), and the flow proceeds to step S125.

In step S125, the CPU 212 outputs a control signal to the motor driving circuit 219, and starts driving the adhesive take-up motor M2 (abbreviated "AD motor" in the figure; refer to the aforementioned FIG. 7A). When step S125 ends, the flow proceeds to step S130.

In step S130, the CPU 212 determines whether or not a predetermined amount of time has passed since the driving of the adhesive take-up motor M2 was started in the above described step S125. If the predetermined amount of time has not passed, the condition of step S130 is not satisfied (step S130: NO), and the flow loops back and enters a standby state until the predetermined amount of time passes. In this case, the predetermined amount of time that the flow is in a standby state may be about the amount of time it takes for the slack of the above described tapes 150-0, 150-1 from the feeding roller 12 to the second roll R2 to be removed and appropriate tension to be applied (1 s maximum, for example). If the predetermined amount of time has passed, the condition of step S130 is satisfied (step S130: YES), and the flow proceeds to step S135.

In step S135, the CPU 212 determines whether or not the second roll R2 is rotating at this moment based on a detection result of a suitable rotation detection sensor (such as an optical sensor, for example; not shown) disposed in accordance with the second roll R2. If the second roll R2 is not rotating, the condition is not satisfied (S135: NO), and the flow proceeds to step S140.

In step S140, the CPU 212 outputs a control signal to the motor driving circuit 219 and stops the driving of the adhesive take-up motor M2. When step S140 ends, the flow proceeds to step S145.

In step S145, the CPU 212 outputs a control signal to the motor driving circuit 220, and starts the driving of the separation sheet take-up motor M3 (abbreviated as "separation sheet motor" in the figure; refer to the aforementioned FIG. 7C). When step S145 ends, the flow proceeds to step S150.

In step S150, the CPU 212 determines whether or not a predetermined amount of time has passed since the start of the driving of the separation sheet take-up motor M3 in the above described step S145. If the predetermined amount of time has not passed, the condition of step S150 is not satisfied (step S150: NO), and the flow loops back and enters a standby state until the predetermined amount of time passes. In this case, the predetermined amount of time that the flow is in a standby state may be about the amount of time it takes for the slack of the separation material layer 151 from the feeding roller 12 to the third roll R3, including the pull-back of the aforementioned separation point, to be removed and appropriate tension to be applied. If the predetermined amount of time has passed, the condition of step S150 is satisfied (step S150: YES), and the flow proceeds to step S155.

In step S155, the CPU 212 determines whether or not the third roll R3 is rotating at this moment based on a detection result of a suitable rotation detection sensor (such as an optical sensor, for example; not shown) disposed in accordance with the third roll R3. If the third roll R3 is not rotating, the condition is not satisfied (S155: NO), and the flow proceeds to step S160.

In step S160, the CPU 212 outputs a control signal to the motor driving circuit 220 and stops the driving of the separation sheet take-up motor M3. When step S160 ends, the flow proceeds to step S165.

In step S165, the CPU 212 outputs a control signal to the motor driving circuits 218, 219, 220, and starts the driving of the feeding motor M1, the adhesive take-up motor M2, and the separation sheet take-up motor M3. When step S165 ends, the flow proceeds to step S170.

In step S170, the CPU 212 determines whether or not a predetermined amount of time has passed since the start of the driving of each motor in the above described step S165. If the predetermined amount of time has not passed, the condition of step S170 is not satisfied (step S170: NO), and the flow loops back and enters a standby state until the predetermined amount of time passes. In this case, the predetermined amount of time that the flow is in a standby state may be about the amount of time that it takes to adequately visually verify whether or not the series of operations including the feed-out and feeding of the print-receiving tape 150, the feeding of the tape 150-0, the feeding and take-up of the tape 150-1, the take-up of the separation material layer 151, and the like will be normally performed. If the predetermined amount of time has passed, the condition of step S170 is satisfied (step S170: YES), and the flow proceeds to step S175.

In step S175, the CPU 212 outputs a control signal to the motor driving circuits 218, 219, 220, and stops the driving of the feeding motor M1, the adhesive take-up motor M2, and the separation sheet take-up motor M3. When step S175 ends, the flow proceeds to step S180.

In step S180, the CPU 212 reports that all operations have been normally performed and the preparation processing has normally ended by displaying so on the display part 215 (or the PC 217) or the like. This flow then terminates here.

On the one hand, if the CPU 212 determines that the second roll R2 had been rotating in the above described step S135, the condition is satisfied (S135: YES), and the flow proceeds to step S185.

In step S185, the CPU 212 outputs a control signal to the motor driving circuit 219 and stops the driving of the adhesive take-up motor M2. When step S185 ends, the flow proceeds to step S190.

In step S190, the CPU 212 regards the second roll R2 as rotating idly since the tip end of the tape 150-1 is not well secured to the winding core 41 for the second roll R2, and reports so by display on the display part 215 (or the PC 217). This flow then terminates here.

Further, on the other hand, if the CPU 212 determines that the third roll R3 had been rotating in the above described step S155, the condition is satisfied (S155: YES), and the flow proceeds to step S195.

In step S195, the CPU 212 outputs a control signal to the motor driving circuit 220 and stops the driving of the separation sheet take-up motor M3.

Subsequently, in step S198, the CPU 212 regards the third roll R3 as rotating idly since the tip end of the separation material layer 151 is not well secured to the winding core 29 for the third roll R3, and reports so by display on the display part 215. This flow then terminates here. When the step S100 ends as described above, the flow proceeds to step S230 in FIG. 10.

Returning to FIG. 10, in step S230, the CPU 212 outputs a control signal to the motor driving circuits 218, 219, 220, and starts the driving of the feeding motor M1, the adhesive take-up (AD) motor M2, and the separation sheet take-up motor M3. With this arrangement, the feeding of the above described print-receiving tape 150, the tape 150' with print, and the tape 150" with print (hereinafter suitably simply referred to as "tape feeding"), and the take-up of the above described tape 150" with print is started (refer to the aforementioned FIG. 8A). When step S230 ends, the flow proceeds to step S235.

In step S235, the CPU 212 determines whether or not the above described tape feeding has arrived where the print head 11 faces the corresponding print start position by a known technique, based on the print data indicating one image that is to be formed by print (by repeated print in the tape longitudinal direction in this example) on the above described print-receiving tape 150, input in the above described step S203. If the feeding has not arrived at the print start position, the condition is not satisfied (S235: NO), and the flow loops back and enters a standby state. If the feeding has arrived at the print start position, the condition of step S235 is satisfied (S235: YES), and the flow proceeds to step S240.

In step S240, the CPU 212 outputs a control signal to the print head control circuit 221, conducts current to the heating elements of the print head 11, and starts repeated print formation (repeated formation of the print part 155 having the same contents) on the above described print-receiving tape 150 as one image corresponding to the above described input print data. When step S240 ends, the flow proceeds to step S245.

In step S245, the CPU 212 determines whether or not the above described tape feeding has arrived where the print head 11 faces the corresponding print end position, by a known technique based on the above described input print data. If the feeding has not arrived at the print end position, the condition is not satisfied (S245: NO), the flow returns to the above described step S240, and the same procedure is repeated. If the feeding has arrived at the print end position, the condition is satisfied (S245: YES), and the flow proceeds to step S250.

In step S250, the CPU 212 outputs a control signal to the print head control circuit 221, stops conducting current to the heating elements of the print head 11 and print formation on the above described print-receiving tape 150. At this time, the tape feeding is continually performed. With this arrangement, a blank state where the print part 155 does not exist (the aforementioned tape 150-0) is thereafter formed on the tape 150' with print. Subsequently, the flow proceeds to step S255.

In step S255, the CPU 212 determines whether or not the above described tape feeding has arrived at the cutting position by the above described cutter 30 (a cutting position such as where the total length along the transport direction of the tape 150" with print wound as the second roll R2 by the take-up mechanism 40 becomes the length intended by the operator), in accordance with the above described total length data acquired in the above described step S202. If the feeding has not arrived at the cutting position, the condition is not satisfied (S255: NO), and the flow loops back and enters a standby state. If the feeding has arrived at the cutting position, the condition is satisfied (S255: YES), and the flow proceeds to step S260.

In step S260, the CPU 212 outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) stops. When step S260 ends, the flow proceeds to step S265.

In step S265, the CPU 212 outputs a control signal to the motor driving circuit 222, drives the above described cutter motor MC, and cuts the tape 150" with print by the operation of the above described cutter 30 (refer to the aforementioned FIG. 9A). When step S265 ends, the flow proceeds to step S270.

Figure 9B:
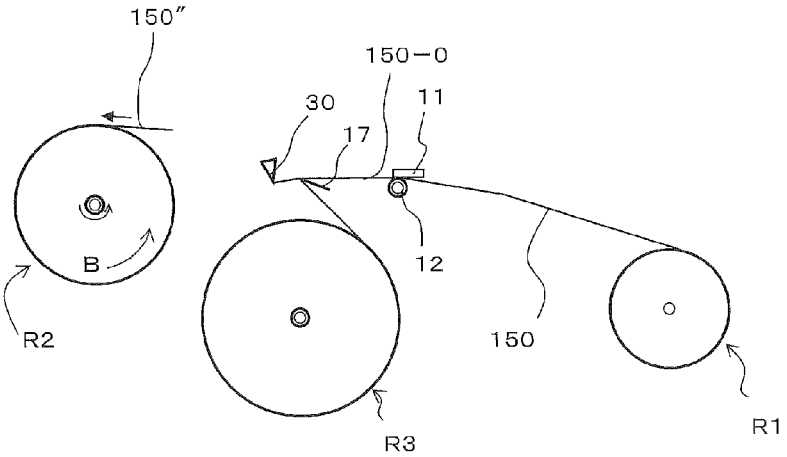

In step S270, the CPU 212 outputs a control signal to the motor driving circuit 219, starts the driving of the adhesive take-up motor M2 and the take-up of the end edge of the tape 150" with print (refer to the aforementioned FIG. 9B). When step S270 ends, the flow proceeds to step S275.

In step S275, the CPU 212 determines whether or not a predetermined amount of time has passed since the cutting operation of the cutter 30 in the above described step S265. If the predetermined amount of time has not passed, the condition is not satisfied (S275: NO), and the flow loops back and enters a standby state. This predetermined amount of time only needs to be a sufficient amount of time for taking up the above described end edge of the tape 150" with print on the above described winding core 41 of the take-up mechanism 40. If the above described predetermined amount of time has passed, this condition is satisfied (S275: YES), and the flow proceeds to step S280.

In step S280, the CPU 212 outputs a control signal to the motor driving circuit 219 and stops the driving of the adhesive take-up motor M2. With this arrangement, the end edge of the tape 150" with print generated by the above described cutting can be reliably taken up. Once step S280 ends, this flow is terminated.

Advantages of the Embodiment

As described above, in the tape printer 1 in this embodiment, when the print-receiving tape 150 is fed by the feeding roller 12, printing based on print data is executed on the fed print-receiving tape 150 by the print head 11. The tape 150" with print after printing has been performed is sequentially taken up around a predetermined axis by the take-up mechanism 40, thereby producing a roll-shaped printed matter.

Then, according to the tape printer 1 in this embodiment, the time required until printed matter production completion is estimated and displayed before the start of production of the above described printed matter. That is, the printing speed by the print head 11 is determined (refer to step S204) based on the input medium information of the print-receiving tape 150 (refer to step S201), and the take-up time by the above described take-up mechanism 40 is predicted and determined (refer to step S205) based on this determined printing speed and the input above described total length data (refer to step S202) of the above described tape 150" with print. Then, the determined take-up time is displayed (refer to step S210).

With this arrangement, before the start of printed matter production, the user can find out the time required until printed matter production is completed. Accordingly, it is possible to improve convenience for the user.

Further, in particular, according to this embodiment, before the start of printed matter production, predetermined preparation processing (refer to the above described FIG. 7A-7C), which includes slack removal by applying tension to the print-receiving tape 150, is performed. When the above described take-up time is determined, the determined time includes the tape take-up time executed during this preparation processing as well. With this arrangement, the user can find out the time required until completion of printed matter production with high accuracy, making it possible to reliably improve convenience.

Further, in particular, in this embodiment, after the cutting by the cutter 30, the above described finishing processing wherein a piece of tape positioned further on the transport-direction downstream side than the cutting area is fully taken up on the roll outer circumference side is performed. Then, when the above described take-up time is determined, the determined time includes the tape take-up time executed during this finishing processing as well. With this arrangement, the user can find out the time required until printed matter production completion with high accuracy, making it possible to more reliably improve convenience.

Further, in particular, according to this embodiment, the remaining time, which is acquired by subtracting the time that has passed since the take-up mechanism 40 started take-up of the tape 150" with print from the determined take-up time, is displayed (refer to step S225). With this arrangement, the user can find out the remaining time until production completion, which constantly changes after the start of printed matter production, in realtime. As a result, convenience can be further improved.

Modifications

Note that the present disclosure is not limited to the above described embodiment, and various modifications may be made without deviating from the spirit and scope of the disclosure. The following describes such modifications one by one.

Determining Take-Up Time Taking into Account Cooling of Print Head

That is, according to this modification, the cooling status resulting from so-called natural cooling and the like in order to suppress the overheating of the print head 11 resulting from printing for a long period of time is predicted. Then, if cooling execution is predicted, the take-up time, including the printing stop time resulting from cooling, is determined.

Control System

Figure 14:
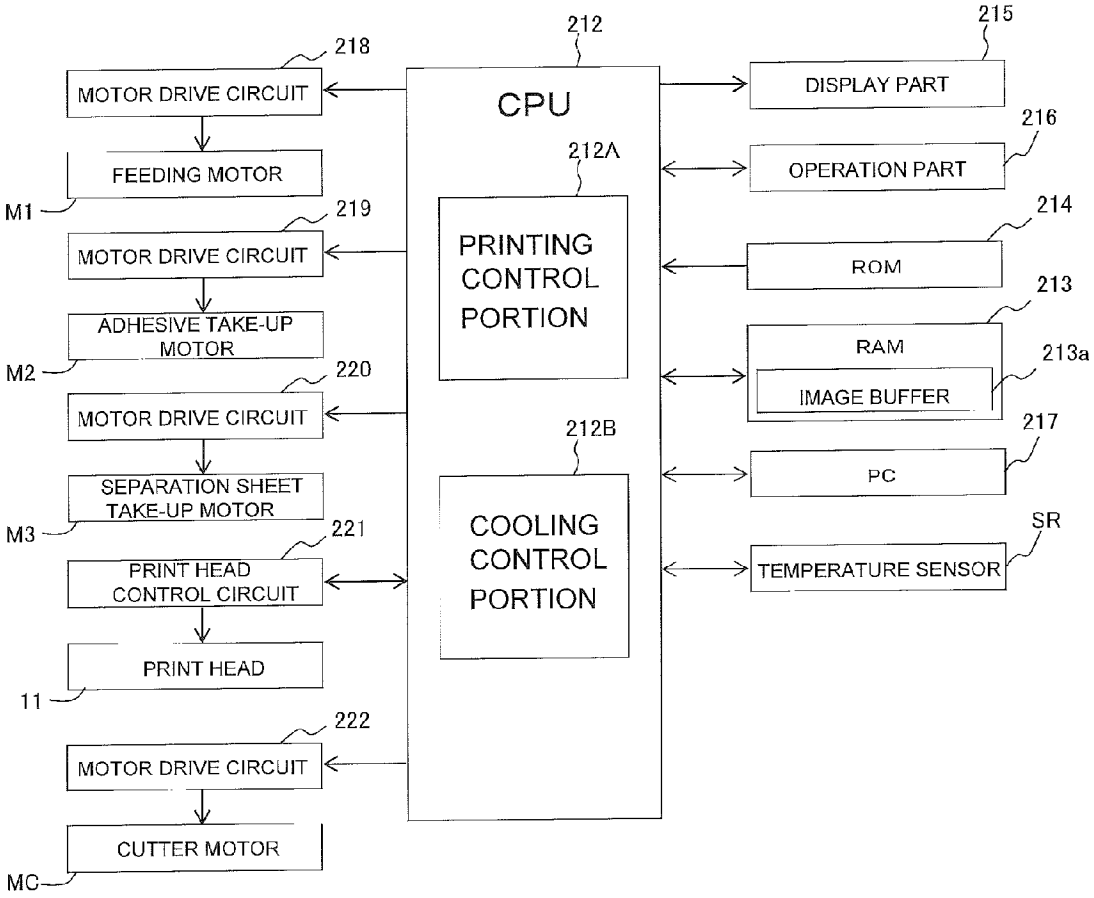
FIG. 14 is a function block diagram showing the configuration of the control system of the tape printer in a modification in which the cooling status of the print head is predicted to determine the take-up time.

FIG. 14 shows the control system of the tape printer 1 in this modification. In the tape printer 1 in this modification, a temperature sensor SR that detects a temperature of the print head 11 is newly connected to the CPU 212. Further, the CPU 212 functionally comprises a print control portion 212A and a cooling control portion 212B.

The print control portion 212A comprises the same functions as those of the CPU 212 in the above described embodiment, and controls the print head 11, the feeding roller 12, the cutter 30, and the like in coordination with each other. On the other hand, the cooling control portion 212B outputs a pause instruction signal (described later) to the print control portion 212A based on the detection result of the above described temperature sensor SR.

Control by Cooling Control Portion

Figure 15:
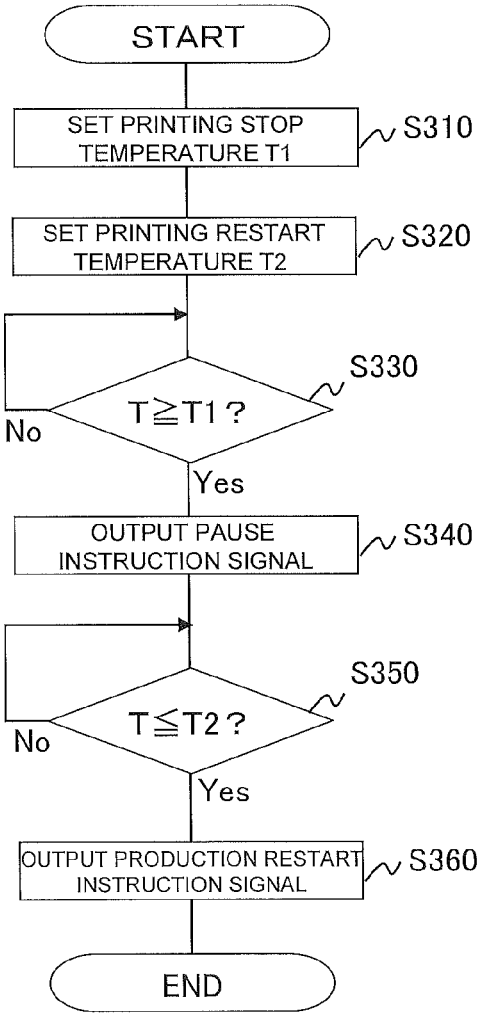
FIG. 15 is a flowchart showing the control procedure of the cooling processing executed by the cooling control portion of the CPU.

First, the control procedure of the cooling processing for print formation executed by the cooling control portion 212B of the CPU 212 will be described using the flow in FIG. 15.

First, in step S310 and step S320, the cooling control portion 212B of the CPU 212 sets a print stop temperature T1 (60° C., for example) at which print formation by the print head 11 is stopped, and a restart temperature T2 (40° C., for example) for restarting print formation once again after it was stopped. respectively. For these settings, values stored in suitable storage means (the above described ROM 214, for example) in advance may be read and stored in the RAM 213, or values corresponding to an operation by the user using the operation part 216 (or the above described PC 217) may be acquired and stored in the RAM 213. Subsequently, the flow proceeds to step S330.

In step S330, the cooling control portion 212B determines whether or not a temperature T of the print head 11 is at least the above described print stop temperature T1 (if $T \geq T1$), based on the detection result of the above described temperature sensor SR. During the period $T < T1$, the condition of step S330 is not satisfied (S330: NO), and the flow loops back and enters a standby state. Once $T \geq T1$, the condition of step S330 is satisfied (S330: YES), and the flow proceeds to step S340.

In step S340, the cooling control portion 212B outputs a pause instruction signal for pausing the print formation processing by the print control portion 212A (refer to step S241 in FIG. 16 described later) to the print control portion 212A. Subsequently, the flow proceeds to step S350.

In step S350, the cooling control portion 212B determines whether or not the temperature T of the print head 11 is the above described restart temperature T2 or less (if $T \leq T2$), based on the detection result of the above described temperature sensor SR. During the period T>T2, the condition of step S350 is not satisfied (S350: NO), and the flow loops back and enters a standby state. Once T≤T2, the condition of step S350 is satisfied (S350: YES), and the flow proceeds to step S360.

In step S360, the cooling control portion 212B outputs a production restart instruction signal for clearing the pause of the print formation processing by the aforementioned pause instruction signal (refer to step S243 in FIG. 16 described later) to the print control portion 212A. Subsequently, this process terminates here.

Control by Print Control Portion

Next, the processing procedure executed by the print control portion 212A of the CPU 212 during print formation in this modification will be described using the flow in FIG. 16.

Figure 16:
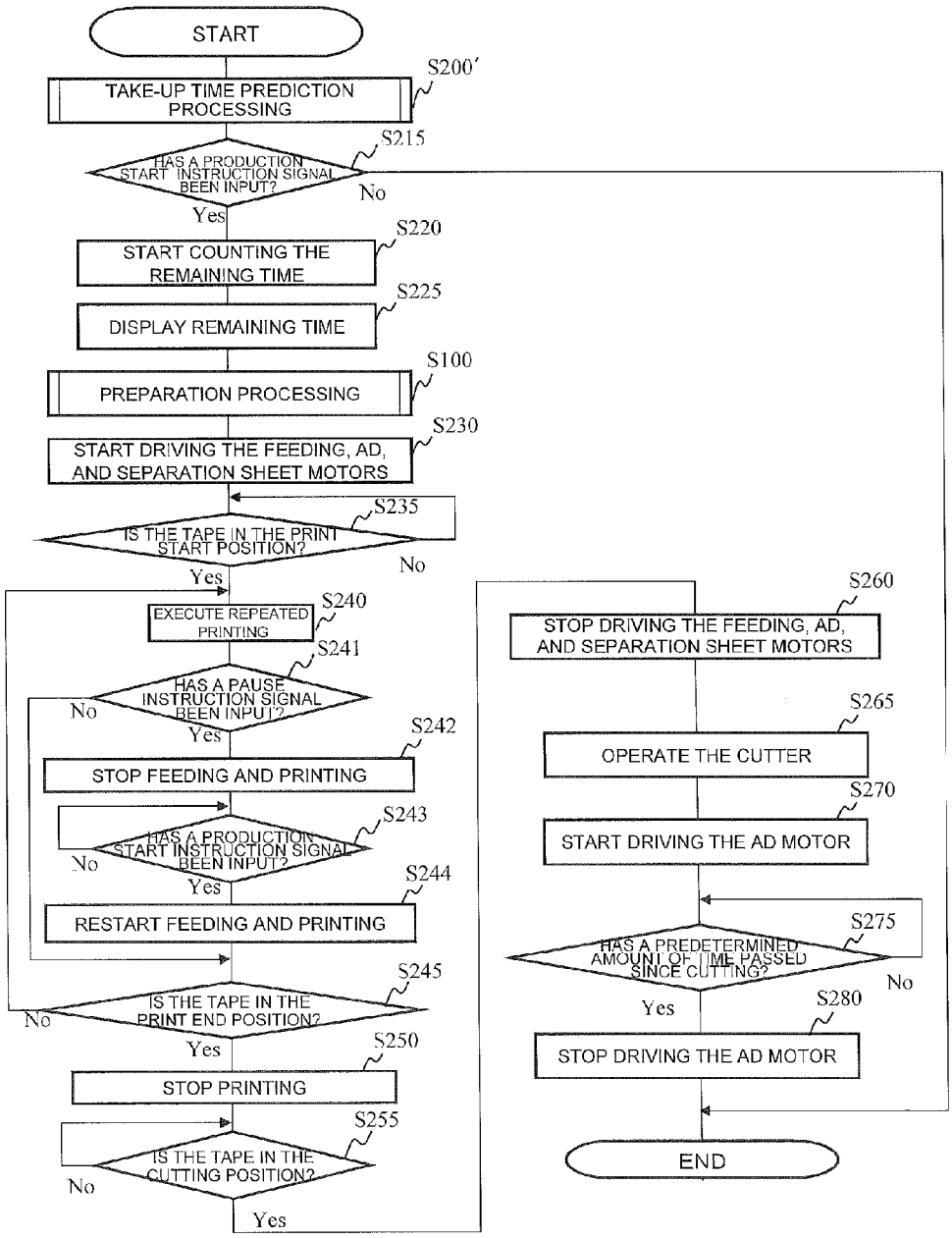
FIG. 16 is a flowchart showing the control procedure executed by the print control portion of the CPU.

The flow shown in FIG. 16 differs in that step S200' is disposed in place of the step S200 in FIG. 10, and step S241, step 242, step S243, and step S244 are newly disposed between step S240 and step S245.

Figure 17:
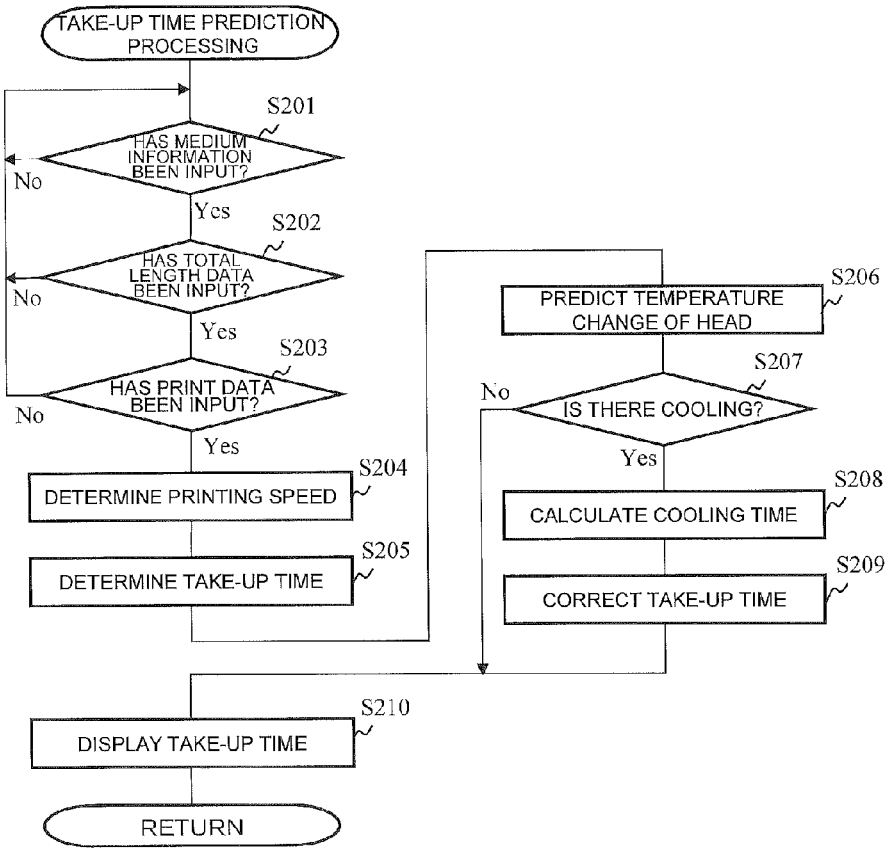
FIG. 17 is a flowchart showing the detailed procedure of step S200' in FIG. 16.

FIG. 17 shows step S200' which is executed first in the flow in FIG. 16. The flow shown in FIG. 17 differs in that steps S206-S209 are newly disposed between step S205 and step S210 in FIG. 11.

In FIG. 17, after the same steps S201-S205 as those in FIG. 11, the flow proceeds to the newly disposed step S206. In step S206, the CPU 212 predicts a temperature change of the print head 11 up to completion of the printed matter production based on the total length data input in the above described step S202, the print data input in step S203, the printing speed determined in step S204, and the like, while referring to the temperature rise characteristics of the print head 11 based on the structure of the tape printer 1, stored in a suitable location (the ROM 214, for example) in advance. When step S206 ends, the flow proceeds to the newly disposed step S207.

In step S207, the CPU 212 determines whether or not cooling of the print head 11 is required based on the temperature change prediction of the print head 11 up to printed matter completion, predicted in the above described step S206. If the predicted temperature of the print head 11 does not reach a predetermined temperature (60° C., for example) set in advance, the print head 11 is regarded as not requiring cooling, the condition is not satisfied (step S207: NO), and the flow proceeds to step S210 described later. If the predicted temperature of the print head 11 reaches at least the above described predetermined temperature, the print head 11 is regarded as requiring cooling, the above described condition is satisfied (step S207: YES), and the flow proceeds to the newly disposed step S208.

In step S208, the CPU 212 calculates the time required during cooling execution of the print head 11. That is, the CPU 212 starts cooling by natural cooling, and calculates the time required for the print head 11 to decrease from the above described predetermined temperature (60 C.° in the above described example) to a predetermined temperature (40° C., for example) set in advance as the end cooling temperature. When step S208 ends, the flow proceeds to the newly disposed step S209.

In step S209, the CPU 212 corrects the above described take-up time by adding the cooling time calculated in the above described step S208 to the take-up time determined in the above described step S205. When step S209 ends, the flow proceeds to step S210. Step S210 is the same as that in the above described FIG. 10, and descriptions thereof will be omitted. Once this step S210 ends, the flow returns to FIG. 16 and proceeds to step S215.

Steps S215-S240 in FIG. 16 are the same as those in FIG. 10, and descriptions thereof will be omitted. When the above described step S240 ends, the flow proceeds to the newly disposed step S241.

In step S241, the print control portion 212A determines whether or not the above described pause instruction signal from the cooling control portion 212B (refer to step S340 in the above described FIG. 15) has been input. During the period in which the above described pause instruction signal is not input, the condition of step S241 is not satisfied (S241: NO), and the flow proceeds to step S245 described later. Once the above described pause instruction signal is input, the condition of step S241 is satisfied (S241: YES), and the flow proceeds to step S242.

In step S242, the print control portion 212A outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print stops. Additionally, the CPU 212 outputs a control signal to the print head control circuit 221, stops conducting current to the heating elements of the print head 11 and print formation on the above described print-receiving tape 150. Subsequently, the flow proceeds to step S243.

In step S243, the print control portion 212A determines whether or not the above described production restart instruction signal from the cooling control portion 212B (refer to step S360 in the above described FIG. 15) has been input. During the period in which the above described production restart instruction signal is not input, the condition of step S243 is not satisfied (S243: NO), and the flow loops back and enters a standby state. Once the above described production restart instruction signal is input, the condition of step S243 is satisfied (S243: YES), and the flow proceeds to step S244.

In step S244, the print control portion 212A, similar to the above described step S230, outputs a control signal to the motor driving circuits 218, 219, 220, starts the driving of the feeding motor M1, the adhesive take-up motor M2, and the separation sheet take-up motor M3, and restarts the tape feeding and the take-up of the above described tape 150" with print. Additionally, the CPU 212, similar to the above described step S240, outputs a control signal to the print head control circuit 221, conducts current to the heating elements of the print head 11, and restarts print formation on the above described print-receiving tape 150. Subsequently, the flow proceeds to step S245.

Thereafter, steps S245-S280 are the same as those in FIG. 10, and descriptions thereof will be omitted.

As described above, in this modification, when printing is performed for a long period of time, so-called cooling is executed to suppress a decrease in durability of the print head 11 resulting from overheating. That is, if the temperature of the print head 11 detected by the temperature sensor SR reaches the print stop temperature T1, printing by the print head 11 is stopped by the control of the print control portion 212A based on the pause instruction signal from the cooling control portion 212B (refer to step S242). Then, when the temperature of the print head 11 decreases up to the print restart temperature T2 by natural cooling and the like after printing is stopped, printing by the print head 11 is restarted by the control of the print control portion 212A based on the production restart instruction signal from the cooling control portion 212B (refer to step S244).

If cooling such as described above is executed during printed matter production, the amount of time until printing is completed is prolonged accordingly. In response, according to this modification, the temperature change behavior of the print head 11 until printed matter production completion, the cooling execution status, the required time during cooling execution, and the like are predicted (refer to steps S206-S208). Then, when it is predicted that cooling is to be executed, the above described take-up time is determined so as to include the required time for the predicted cooling (refer to step S209). With this arrangement, the user can find out the time required until printed matter production completion with even higher accuracy, making it possible to more reliably improve convenience.

Note that, in the above, the arrows shown in FIG. 6 and FIG. 14 denote an example of signal flow, but the signal flow direction is not limited thereto.

Also note that the present disclosure is not limited to the procedures shown in the above described flows of the flowcharts in FIG. 10, FIG. 11, FIG. 13, FIG. 15, FIG. 16, and FIG. 17, and procedure additions and deletions as well as sequence changes and the like may be made without deviating from the spirit and scope of the disclosure.

Further, other than that already stated above, techniques based on the above described embodiments and the modifications may be suitably utilized in combination as well.

What is claimed is:

1. A recording apparatus comprising:

a feeding roller configured to feed a long medium to be recorded;

a medium information acquiring portion configured to acquire medium information related to said medium to be recorded;

a data acquiring portion configured to acquire record data for recording on said medium to be recorded;

a recording head configured to perform recording in accordance with said record data acquired by said data acquiring portion on said medium to be recorded fed by said feeding roller, and form a recorded medium;

a take-up body configured to sequentially take up said recorded medium around a predetermined axis and produce roll-shaped recorded matter;

a recording speed determining portion configured to determine a recording speed by said recording head based on said medium information acquired by said medium information acquiring portion;

a total length acquiring portion configured to acquire a total recording length by said recording head; and a take-up time determining portion configured to predict and determine a take-up time by said take-up body before said take-up body starts take-up of said recorded medium, based on said total recording length acquired by said total length acquiring portion and said recording speed determined by said recording speed determining portion.

2. The recording apparatus according to claim 1, wherein:

said total length acquiring portion is configured to acquire said total recording length input by an operation via an operation part.

3. The recording apparatus according to claim 1, further comprising a memory part configured to store a recording speed table in which a plurality of recording modes are set for each material of said medium to be recorded, wherein:

said recording speed determining portion is configured to determine said recording speed while referring to said recording speed table, based on said mode selected and input via an operation part and said medium information acquired by said medium information acquiring portion.

4. The recording apparatus according to claim 1, wherein:

said take-up time determining portion is configured to determine said take-up time which includes a medium take-up time during a preparation operation performed before a start of production of said roll-shaped recorded matter.

5. The recording apparatus according to claim 4, wherein:

said take-up time determining portion is configured to determine said take-up time which includes a recording formation time acquired by dividing said total recording length by said recording speed, and said medium take-up time during said preparation operation set in a fixed manner.

6. The recording apparatus according to claim 1, further comprising a cutter configured to cut said recorded medium, wherein said take-up time determining portion is configured to determine said take-up time which includes a medium take-up time during a finishing operation performed after cutting by said cutter.

7. The recording apparatus according to claim 6, wherein:

said take-up time determining portion is configured to determine said take-up time which includes a recording formation time acquired by dividing said total recording length by said recording speed, and said medium take-up time during said finishing operation set in a fixed manner.

8. The recording apparatus according to claim 1, further comprising:

a first display signal output portion configured to output a first display signal that displays said take-up time determined by said take-up time determining portion.

9. The recording apparatus according to claim 1, further comprising a remaining time determining portion configured to determine a remaining time acquired by subtracting an amount of time that has passed since a start of take-up work by said take-up body from said take-up time determined by said take-up time determining portion.

10. The recording apparatus according to claim 9, further comprising:

a second display signal output portion configured to output a second display signal that displays said remaining time determined by said remaining time determining portion.

11. The recording apparatus according to claim 1, further comprising a temperature detecting portion configured to detect a temperature of said recording head;

a stop control portion configured to stop said recording by said recording head and execute cooling in a case that a detected temperature by said temperature detecting portion reaches a predetermined recording stop temperature; and a cooling predicting portion configured to predict a temperature change behavior of said recording head detected by said temperature detecting portion until production completion of said roll-shaped recorded matter, an existence or a non-existence of execution of said cooling, and a required time during said cooling execution, based on said record data acquired by said data acquiring portion and said total recording length acquired by said total length acquiring portion, wherein said take-up time determining portion comprises a correcting portion configured to correct said take-up time by using the required time during said cooling execution predicted by said cooling predicting portion.

12. The recording apparatus according to claim 11, wherein:

said cooling predicting portion is configured to predict the temperature change behavior of said recording head, the existence or the non-existence of execution of said cooling, and the required time during said cooling execution while referring to temperature rise characteristics of said recording head stored in advance, based on said total recording length, said recording data, and said recording speed.

13. The recording apparatus according to claim 1, wherein:

said medium to be recorded is an adhesive tape comprising an adhesive layer.

14. The recording apparatus according to claim 1, wherein:

said recording head is configured to repeatedly record unit image data corresponding to said record data acquired by said data acquiring portion a plurality of times along a longitudinal direction of said medium to be recorded.

* * * * *